US007021089B2

(12) United States Patent
Ions

(10) Patent No.: US 7,021,089 B2
(45) Date of Patent: Apr. 4, 2006

(54) LAUNDRY APPLIANCE

(75) Inventor: David Ions, Shirvenham (GB)

(73) Assignee: Dyson Limited, Wiltshire (GB)

( * ) Notice: Subject to any disclaimer, the term of this patent is extended or adjusted under 35 U.S.C. 154(b) by 217 days.

(21) Appl. No.: 10/312,675

(22) PCT Filed: Jul. 3, 2001

(86) PCT No.: PCT/GB01/02974

§ 371 (c)(1),
(2), (4) Date: Dec. 31, 2002

(87) PCT Pub. No.: WO02/10498

PCT Pub. Date: Feb. 7, 2002

(65) Prior Publication Data

US 2003/0196459 A1 Oct. 23, 2003

(30) Foreign Application Priority Data

Jul. 28, 2000 (GB) ..... 0018399

(51) Int. Cl.
*D06F 37/04* (2006.01)

(52) U.S. Cl. ..... 68/24; 68/58; 68/142

(58) Field of Classification Search ..... 68/24, 68/25, 58, 140, 142
See application file for complete search history.

(56) References Cited

U.S. PATENT DOCUMENTS

| | | | | | |
|---|---|---|---|---|---|
| 1,338,501 | A | * | 4/1920 | Erich | 68/156 |
| 1,636,177 | A | * | 7/1927 | Gage | 210/380.1 |
| 1,722,984 | A | * | 7/1929 | Hendry | 210/179 |
| 1,878,254 | A | * | 9/1932 | Warren | 68/148 |
| 1,897,613 | A | * | 2/1933 | Jensen | 165/72 |
| 1,970,551 | A | * | 8/1934 | Berge | 127/56 |
| 2,075,175 | A | * | 3/1937 | Byrd | 426/491 |
| 2,106,986 | A | * | 2/1938 | Pearce | 68/1 |
| 2,281,616 | A | * | 5/1942 | Placek | 261/83 |
| 2,416,405 | A | * | 2/1947 | Purpura | 34/134 |
| 2,552,282 | A | * | 5/1951 | Karas | 68/157 |
| 2,730,887 | A | * | 1/1956 | Howlett | 68/139 |
| 2,795,125 | A | * | 6/1957 | Sessions | 68/10 |
| 2,968,970 | A | * | 1/1961 | Lepper | 74/573 R |
| 3,062,031 | A | * | 11/1962 | Balik | 68/23.5 |
| 3,078,702 | A | * | 2/1963 | Conlee | 68/20 |
| 3,145,551 | A | * | 8/1964 | Ziegler | 68/4 |
| 3,200,622 | A | * | 8/1965 | Brucken | 68/18 F |
| 3,275,150 | A | * | 9/1966 | Tait | 210/327 |
| 3,300,869 | A | * | 1/1967 | Bergeson et al. | 34/527 |
| 3,372,810 | A | * | 3/1968 | Kletschke | 210/210 |

(Continued)

FOREIGN PATENT DOCUMENTS

| | | | |
|---|---|---|---|
| BE | 583803 | * | 1/1977 |

(Continued)

OTHER PUBLICATIONS

WO 97/15709 May 1997.*

*Primary Examiner*—Frankie L. Stinson
(74) *Attorney, Agent, or Firm*—Morrison & Foerster LLP

(57) ABSTRACT

A laundry appliance such as a washing machine includes an outer housing and a drum rotatably mounted therein. The drum has an inner wall and an outer wall separate from the inner wall, the inner and outer walls being perforated to allow washing liquid to flow into and out of the drum via the perforations. The area of the perforations per unit area of the outer wall is greater than the area of the perforations per unit area of the inner wall.

26 Claims, 4 Drawing Sheets

U.S. PATENT DOCUMENTS

| | | | | | |
|---|---|---|---|---|---|
| 3,400,871 | A | * | 9/1968 | Davis | 266/101 |
| 3,412,529 | A | * | 11/1968 | Tailor | 95/213 |
| 3,633,743 | A | * | 1/1972 | Gooding et al. | 209/250 |
| 3,735,873 | A | * | 5/1973 | Bergstedt | 210/415 |
| 3,740,975 | A | * | 6/1973 | Cornelius | 68/18 F |
| 3,779,047 | A | * | 12/1973 | Fleissner | 68/5 D |
| 4,119,542 | A | * | 10/1978 | Yamaoka et al. | 210/360.2 |
| 4,122,692 | A | * | 10/1978 | Dose | 69/30 |
| 4,266,413 | A | * | 5/1981 | Yli-Vakkuri | 68/158 |
| 4,485,646 | A | * | 12/1984 | Henricson | 68/18 F |
| 4,493,769 | A | * | 1/1985 | Paschedag et al. | 210/360.2 |
| 4,637,231 | A | * | 1/1987 | McMillan et al. | 68/4 |
| 5,058,401 | A | * | 10/1991 | Nakamura et al. | 68/19.2 |
| 5,174,907 | A | * | 12/1992 | Chown et al. | 210/791 |
| 5,433,849 | A | * | 7/1995 | Zittel | 210/324 |
| 5,569,373 | A | * | 10/1996 | Smith et al. | 210/90 |
| 5,575,080 | A | * | 11/1996 | Fleissner | 34/122 |
| 5,661,989 | A | * | 9/1997 | Jeon et al. | 68/18 F |
| 5,671,617 | A | * | 9/1997 | Park et al. | 68/53 |
| 5,715,708 | A | * | 2/1998 | Park | 68/53 |
| 5,837,138 | A | * | 11/1998 | Boele | 210/237 |
| 5,882,529 | A | * | 3/1999 | Gupta | 210/784 |
| 6,041,626 | A | * | 3/2000 | Jung | 68/23.2 |
| D426,686 | S | * | 6/2000 | Clausen et al. | D32/29 |
| 6,727,402 | B1 | * | 4/2004 | Bruss et al. | 602/43 |

FOREIGN PATENT DOCUMENTS

| | | | |
|---|---|---|---|
| DE | 24 43 125 | * | 3/1976 |
| DE | 32 02 529 A1 | | 8/1983 |
| GB | 589067 | | 6/1947 |
| GB | 635258 | | 4/1950 |
| GB | 717974 | | 11/1954 |
| GB | 2 268 939 A | | 1/1994 |
| JP | 2-213389 | * | 8/1990 |
| JP | 4-100966 | * | 4/1992 |
| WO | WO 99/58753 | | 11/1999 |

* cited by examiner

LAUNDRY APPLIANCE

FIELD OF THE INVENTION

The invention relates to a laundry appliance. Particularly, but not exclusively, the invention relates to a washing machine.

BACKGROUND OF THE INVENTION

A washing machine generally consists of an outer casing in which is mounted a water-tight interior container or tub. A perforated drum is commonly mounted inside the tub in a manner which allows the drum to rotate with respect to the tub. During operation, washing liquid is contained within the tub and the laundry to be washed is located within the perforated drum. The laundry is agitated, either by slow rotation of the drum or by the operation of an agitator located within the drum. When the laundry has been washed, some washing liquid is drained from the tub and further washing liquid is extracted from the laundry by spinning of the drum within the interior container to spin washing liquid therefrom. The extracted water exits the drum through the perforations in the wall thereof. Extraction of rinse water is achieved in a similar manner.

It is understood that more water can be extracted from the laundry if the drum is spun at higher spin speeds. There is thus a tendency to spin the drum at as high a spin speed as possible. Increasing the spin speed, however, results in the need for a stronger drum. One way to achieve this is to manufacture the drum with an inner wall and an outer wall. A drum having this type of configuration is illustrated in WO 99/58753. There is a risk, however, that water which is being spun out of the drum during the spinning stage of a washing cycle will be retained between the inner and outer walls of the drum. This would add to the effective weight of the drum and result in excessive consumption of energy.

SUMMARY OF THE INVENTION

It is an object of the present invention to provide a laundry appliance in which the drum is arranged so as to have adequate strength to withstand the stresses imposed on it at high spin speeds and also to allow the egress of water or washing liquid from the interior of the drum through the perforated walls in a manner which discourages water retention between the inner and outer walls. It is a further object of the present invention to provide a laundry appliance in which the drum has an outer wall and an inner wall and water egress therethrough is at least as rapid as it would be through a drum having only a single wall.

The invention provides a laundry appliance comprising an outer housing and a drum mounted rotatably therein, the drum comprising an inner wall and an outer wall, the inner and outer walls being perforated to allow washing liquid to flow into and out of the drum via the perforations, characterised in that the area of the perforations per unit area of the outer wall is greater than the area of the perforations per unit area of the inner wall.

The provision of two separate walls of the drum maintains the strength thereof. The provision of perforations in the outer wall having an area per unit area of the outer wall greater than the corresponding area of the perforations in the inner wall reduces the risk of water being retained within the space between the inner and outer walls.

Preferably, the total area of the perforations in the outer wall per unit area thereof is at least 10% bigger than the total area of the perforations in the inner wall per unit area thereof. More preferably, the total area of the perforations in the outer wall per unit area thereof is at least 20% bigger than the total area of the perforations in the inner wall per unit area thereof. The comparatively large area of the perforations in the outer wall is useful in preventing water build-up in the space between the inner and outer walls.

BRIEF DESCRIPTION OF THE DRAWINGS

Embodiments of the invention will now be described with reference to the accompanying drawings, in which.

DETAILED DESCRIPTION OF THE INVENTION

Figure 1:
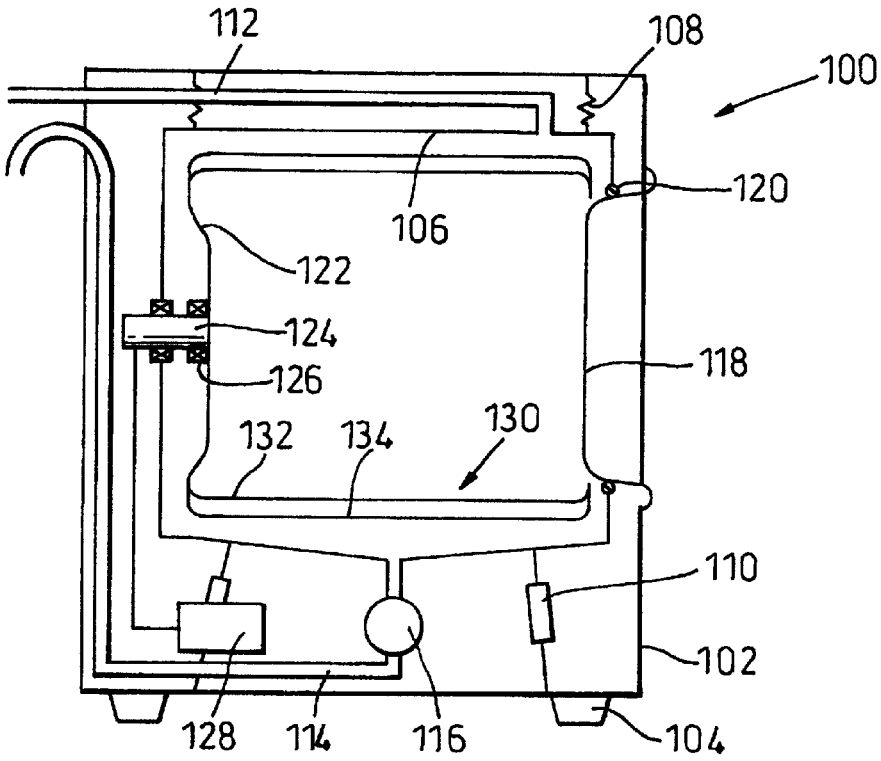
FIG. 1 is a schematic sectional side view of a laundry appliance according to the invention.

A laundry appliance in the form of a washing machine 100 is shown in schematic sectional side view in FIG. 1. The washing machine 100 comprises an outer casing 102 which is supported on feet 104. A water-tight tub 106 is mounted inside the outer casing 102 by means of springs 108 and dampers 110 in a known manner. In this way, the tub 106 is able to move within certain limits with respect to the outer casing 102. A water inlet 112 communicates with an upper portion of the tub 106 and is connectable (by connection means not shown) to a suitable water supply. A water outlet 114 communicates with the bottom of the tub 106 and has a water pump 116 located therein so that water can be drained from the tub 106 to a suitable drain. A door 118 is located in the front of the outer casing 102 so as to provide access to the interior of the tub 106. A flexible seal 120 is provided between the tub 106 and the door 118 when the door 118 is in its closed position.

A drum 122 is rotatably mounted inside the tub 106. The drum 122 is supported in cantilever fashion on a shaft 124 which, in turn, is rotatably supported on the tub 106 by bearings 126. A motor 128 is provided inside the outer casing 102 and is connected in suitable fashion to the shaft 124 in order to effect rotation of the drum 122 about its own longitudinal axis. The drum 122 has cylindrical walls 130 which are perforated so as to allow water to pass through the cylindrical walls 130 of the drum 122.

The features of the washing machine described 100 thus far are known. In operation, articles to be washed are introduced to the interior of the drum 122 via the door 118. Thereafter, the door 118 is closed. Water is then introduced to the tub 106 via the water inlet 112. Detergent is introduced to the interior of the tub 106 in any of a variety of known ways (e.g. via a soap tray, detergent ball or tablets). As the water level in the tub 106 rises, water enters the interior of the drum 122 via the perforations in the cylindrical walls 130 and wets the articles to be washed. A washing action is carried out by operation of the motor 128 which causes the drum 122 to rotate about its own longitudinal axis inside the tub 106. The speed of rotation is chosen so that the wet articles are lifted out of the washing liquid and subsequently dropped back thereinto. This known action effectively removes dirt from the articles to be washed.

When the washing portion of the cycle is complete, the pump 116 is operated so that water is drained from the lower part of the tub 106 and passed to a drain via the water outlet 114. Washing liquid is further extracted from the wet laundry articles by increasing the speed of rotation of the drum 122 so that water is centrifugally extracted from the laundry articles and flung outwardly through the perforations in the cylindrical walls 130. Water thus extracted drains to the lower portion of the tub 106 and is then pumped away to the drain via the water outlet 114. Rinse water is then introduced to the tub 106 via the water inlet 112, a tumbling action is carried out so as to extract detergent from the laundry articles and the rinse water is then drained and spun out of the laundry articles as described above. This rinsing procedure is commonly repeated at least three times.

The method outlined above is not new. Modifications to and variations on the washing machine 100 and the method just described above are well known in the art and can be incorporated into the washing machine 100 and its operation without departing from the scope of the invention.

The present invention relates to the construction of the drum 122, particularly to the construction of the cylindrical walls 130. In order to reduce the time required to dry articles which have been washed by an automatic washing machine, there is a general desire to increase the speed at which the drum of the washing machine rotates or spins. Increasing the spin speed generally extracts more water from the laundry articles and therefore drying can be achieved in a shorter time. However, increasing the spin speed necessitates some strengthening of the rotatable drum 122. In order to strengthen the drum 122, the cylindrical wall 130 consists of an inner wall 132 and an outer wall 134, in contrast to a cylindrical wall having a single layer.

The inner wall 132 lies parallel to the outer wall 134 and, in the embodiment shown in FIG. 1, the inner wall 132 extends across the entire depth of the drum 122. In an alternative embodiment, shown in FIG. 2, the drum arrangement is slightly different. Whilst all other components shown in FIG. 2 remain identical to those illustrated in FIG. 1, the drum 222 shown in FIG. 2, and its support means, are not. Specifically, the drum 222 comprises a first rotatable portion 222*a* and a second rotatable portion 222*b*. The first rotatable portion 222*a* is rotatably supported in cantilever fashion, as before, by way of a first shaft 224*a*. The second rotatable portion 222*b* is also supported in cantilever fashion, this time on a second shaft 224*b*, which is rotatably mounted inside the first shaft 224*a*. The second rotatable portion 222*b* is located inside the first rotatable portion 222*a* at the end thereof adjacent the shafts 224*a*,224*b*. The motor 228 is arranged so as to be able to drive the rotatable portions 222*a*,222*b* by way of the shafts 224*a*,224*b* so that relative rotation therebetween is achieved. The details and advantages of such an arrangement are set out and described in detail in WO99/58753.

The second rotatable portion 222*b* extends across approximately one half of the depth of the drum 222. In the area in which the second rotatable portion 222*b* is provided (ie. the area adjacent the shafts 224*a*,224*b*), the second rotatable portion 222*b* forms an inner wall 232. Radially outwardly of the second rotatable portion 222*b*, lies part of the first rotatable portion 222*a*. This part of the first rotatable portion 222*a* forms an outer wall 234. Beyond the furthest extent of the second rotatable portion 222*b*, the first rotatable portion 222*a* has a construction similar to that shown in FIG. 1, i.e. the first rotatable portion 222*a* has a cylindrical wall 230 comprising an inner wall 232*a* and an outer wall 234*a*.

As can be seen from the forgoing descriptions, most, if not all, of the cylindrical wall of the drum 122,222 comprises an inner wall 132,232,232*a* and an outer wall 134,234,234*a*. In the embodiment shown in FIG. 1, the inner wall 132 and the outer wall 134 are fixedly joined together so that the inner and outer walls 132,134 rotate together. Although the configuration of the embodiment shown in FIG. 2 allows the first and second rotatable portions 222*a*,222*b* to rotate independently of one another, the washing machine 200 will be configured and arranged so that the first and second rotatable portions 222*a*,222*b* of the drum 222 will be rotated at the same speed and in the same direction during any spinning steps of the washing cycle. Thus, the first and second rotatable portions 222*a*,222*b* will behave as a single unit during the water extraction steps. In either embodiment, water extracted from the laundry articles must therefore pass through both the inner wall 132,232,232*a* and the outer wall 134,234,234*a* during spinning.

Figure 2:
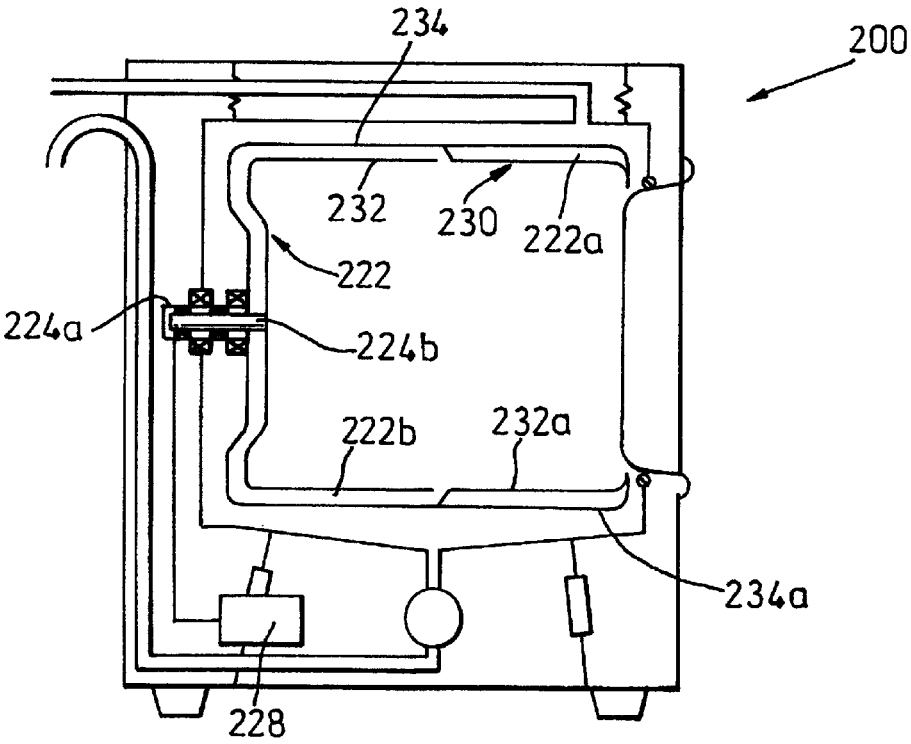
FIG. 2 is a schematic sectional side view of an alternative embodiment of the laundry appliance shown in FIG. 1.
Figure 3:
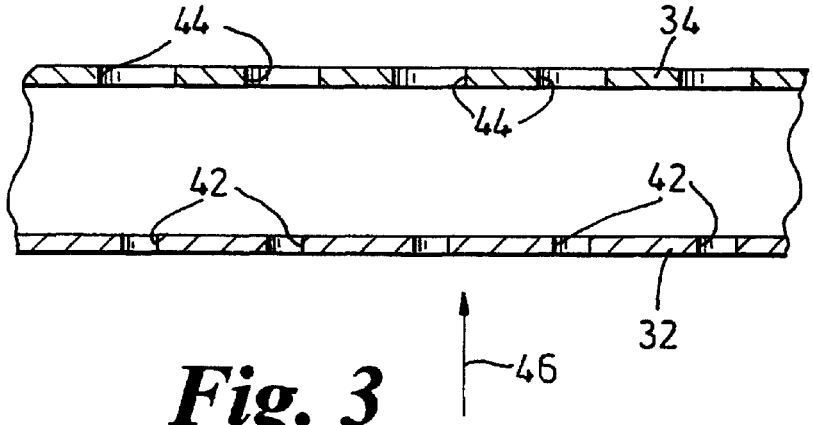
FIG. 3 is a sectional view, shown on a greatly enlarged scale, of a portion of a drum forming part of the washing machine shown in either of FIGS. 1 and 2.

FIG. 3 shows, on a greatly enlarged scale, part of an inner wall 32 and an outer wall 34 which could be used in either of the washing machines 100,200 illustrated in FIGS. 1 and 2. Both walls 32,34 are made from metal (e.g. stainless steel) and have appropriate perforations formed therein by either punching or stamping. The inner wall 32 comprises an array of perforations 42 and the outer wall 34 comprises an array of perforations 44. Arrow 46 indicates the direction of water flow during a spinning step of the washing procedure.

Figure 4:
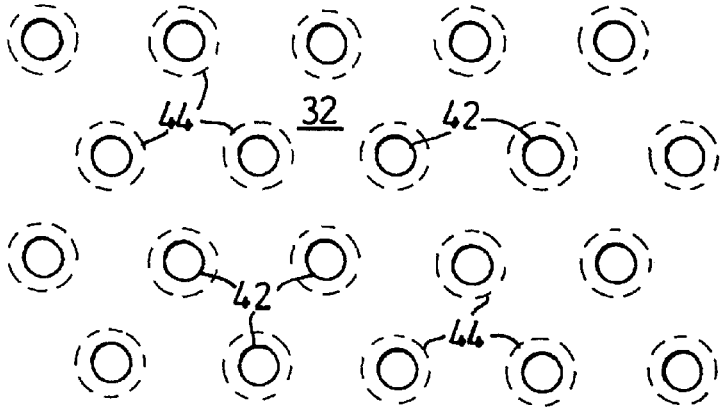
FIG. 4 is a plan view of the wall portion shown in FIG. 3 showing the hole configuration thereof.

FIG. 4 is a plan view, looking along the arrow 46, of the inner wall 32 shown in FIG. 3. The perforations 42 are shown in bold lines with the perforations 44 formed in the outer wall 34 shown in dotted lines. As can be seen, the perforations 42 in the inner wall 32 form a regular array of holes having a 5 mm diameter and spaced 2 cm apart in horizontal rows. The rows of perforations 42 are spaced 1.5 cm apart and alternate rows are offset by 1 cm with respect to the adjacent rows. The perforations 44 located in the outer wall 34 are arranged in an identical array but have a diameter of 10 mm. Thus, the total area of the perforations 44 in the outer wall 34 per unit area thereof is four times larger than the total area of the perforations 32 in the inner wall 32 per unit area thereof.

Figure 5:
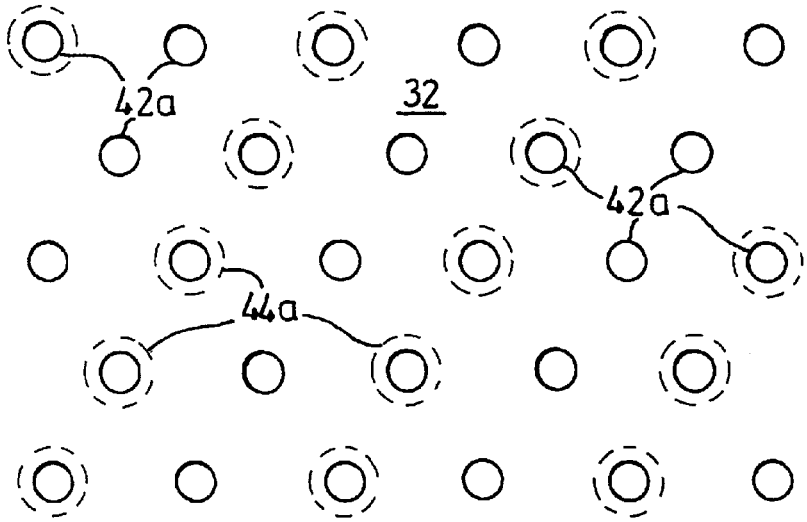
FIG. 5 is a plan view, similar to FIG. 4, of an alternative wall portion having a first alternative hole configuration.

An alternative arrangement is illustrated in FIG. 5. In FIG. 5, the array of perforations 42*a* in the inner wall 32 is identical to that of the perforations 42 shown in FIG. 4. The array of perforations 44*a* formed in the outer wall 34 is similar to that of the perforations 44 shown in FIG. 4, except that alternate perforations 44*a* are omitted. Thus, a perforation 44*a* is provided in respect of only alternate perforations 42*a*. The total area of the perforations 44*a* in the outer wall 34 per unit area thereof is thus only twice as large as the total area of the perforations 42*a* in the inner wall 32 per unit area thereof.

In the arrangements shown in FIGS. 3, 4 and 5, each perforation 44, 44*a* in the outer wall 34 is radially aligned with a perforation 42,42*a* in the inner wall 32. By this we mean that, if a line were to be drawn radially from the axis of rotation of the drum 122,222 through the centre of any one of the perforations 44,44*a* in the outer wall 34, then it would have already passed through the centre of a perforation 42,42*a* in the inner wall 32 by the time it reached the outer wall 34.

Figure 6:
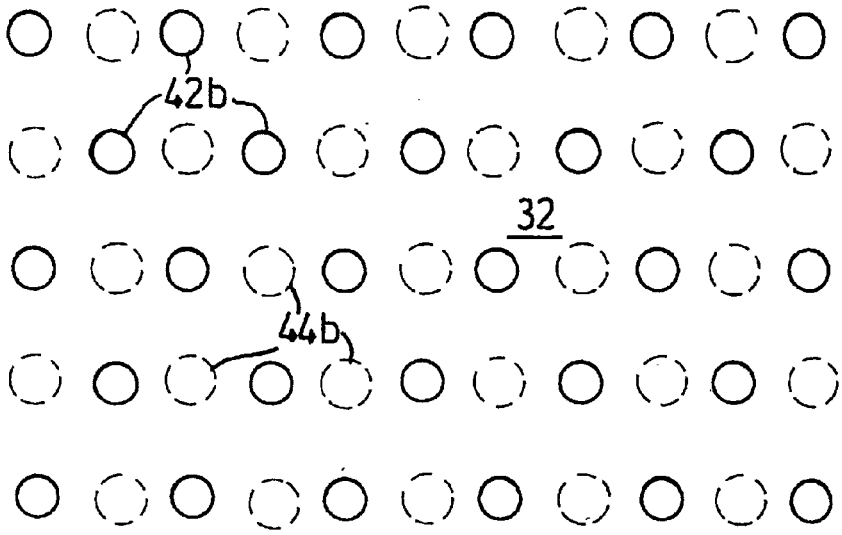
FIGS. 6 to 9 are further plan views, similar to FIGS. 4 and 5, of further alternative wall portions having second, third, fourth and fifth alternative hole configurations.

Radial alignment is, however, not essential to this invention. FIG. 6 shows a second alternative arrangement in which the array of perforations 42*b* in the inner wall 32 is the same as that shown in FIGS. 4 and 5. Again, the diameter of each perforation 42*b* is 5 mm. However, the array of perforations 44*b* arranged in the outer wall 34 is different from either of those shown in FIGS. 4 and 5. In this embodiment, the perforations 44*b* are offset from the perforations 42*b* in the inner wall 32 by 1 cm. Furthermore, the diameter of the perforations 44*b* is 6 mm. This results in the total area of the perforations 44*b* in the outer wall 34 per unit area thereof being approximately 40% greater than the total area of the perforations 42*b* in the inner wall 32 per unit area thereof.

Figure 7:
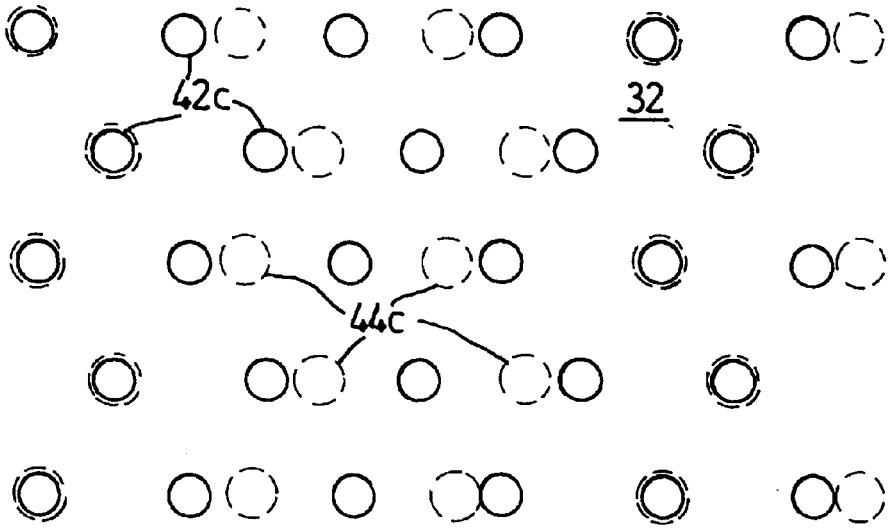

A further alternative configuration is illustrated in FIG. 7. Once again, the array of perforations 42*c* formed in the inner wall 32 is the same as that illustrated in FIGS. 4, 5 and 6. However, the array of perforations 44*c* formed in the outer wall 34 is different. As in the embodiment illustrated in FIG. 6, the diameter of the perforations 44*c* is 6 mm. However, there are fewer perforations 44*c* formed in the outer wall 34 as illustrated in FIG. 7. In this arrangement, only three perforations 44*c* are provided for every four perforations 42*c*. This arrangement gives a total area of the perforations 44*c* in the outer wall 34 per unit area thereof of approximately 10% more than the total area of the perforations 42*c* in the inner wall 32 per unit area thereof.

Figure 8:
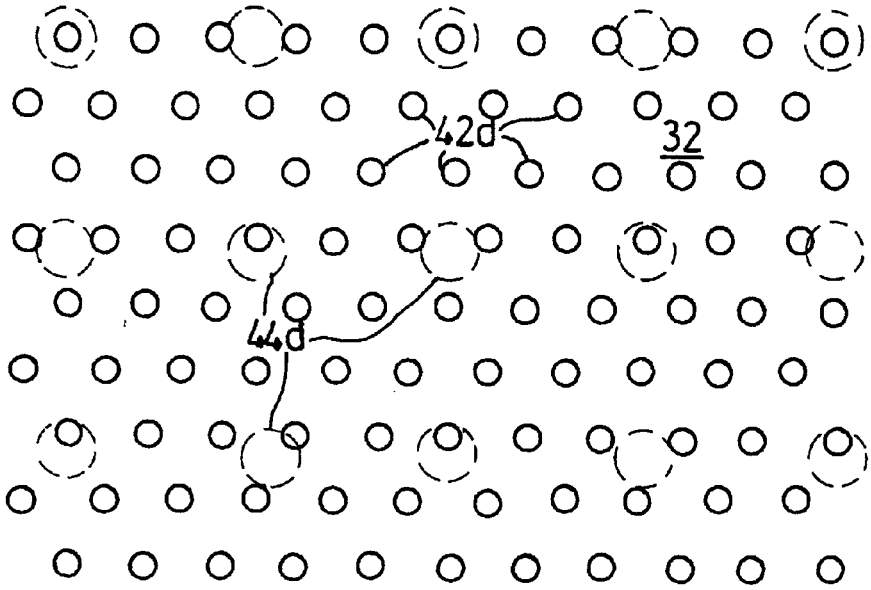

A third alternative embodiment is illustrated in FIG. 8. In this embodiment, the array of perforations 42*d* formed in the inner wall 32 comprises rows of perforations 42*d* of 3 mm diameter spaced apart horizontally by a distance of 1 cm. Adjacent rows are spaced vertically by a distance of 8.5 mm and offset by a distance of 5 mm. The array of perforations 44*d* formed in the outer wall 34 is made up of horizontal rows of perforations 44*d* of 8 mm diameter and spaced apart by 2.5 cm. Adjacent rows, which are not offset, are spaced apart by 2.7 cm. In this embodiment, the total area of the perforations 44*d* in the outer wall 34 per unit area thereof is approximately 5% greater than the total area of the perforations 42*d* in the inner wall 32 per unit area thereof.

Figure 9:
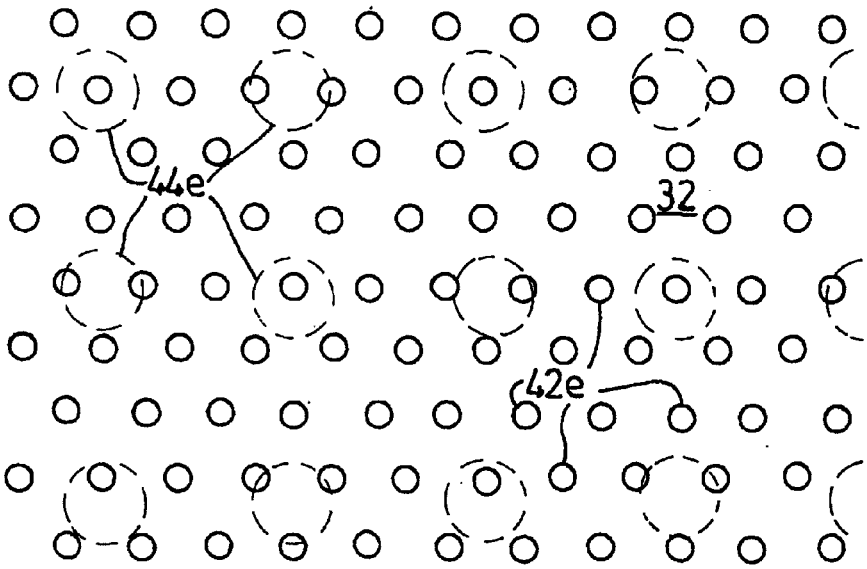

A fourth alternative embodiment is illustrated in FIG. 9. This embodiment is similar to that shown in FIG. 8 except that, in FIG. 9, the diameter of the perforations 44*e* formed in the outer wall 34 is 11 mm instead of 8 mm. This arrangement provides a total area of the perforations 44*e* in the outer wall 34 per unit area thereof which is approximately twice the total area of the perforations 42*e* in the inner wall 32 per unit area thereof.

It will be appreciated that the structure and specific features of the washing machine 100,200 described above are mostly irrelevant to the present invention. Therefore, alternative constructions of the support bearings, shafts, water inlet, water drain, door, etc and methods of operation can be provided without departing from the scope of the invention. The invention relates simply to the construction of the cylindrical walls of the drum and features which do not relate to this are regarded as inessential to the invention.

By providing an array of perforations in the outer wall of the drum which has a total area of perforation per unit area of the said wall which is greater than the area of the perforations provided in the inner wall per unit area thereof, it is perceived that the likelihood of build up of water between the inner and outer walls during extraction therethrough will be reduced.

The invention claimed is:

1. A laundry appliance comprising an outer housing defining a washing space, a drum mounted rotatably in the outer housing and a door in the outer housing closing the washing space, the drum comprising an inner side wall and an outer side wall separate from the inner side wall, the inner and outer side walls being perforated to allow washing liquid to flow into and out of the drum via the perforations, wherein the area of the perforations per unit area of the outer side wall is greater than the area of the perforations per unit area of the inner side wall.

2. A laundry appliance as claimed in claim 1, wherein all of the perforations are circular.

3. A laundry appliance as claimed in claim 1 or 2, wherein the perforations in the inner side wall are all the same size.

4. A laundry appliance as claimed in claim 3, wherein all of the perforations in the outer side wall are larger than any of the perforations in the inner side wall.

5. A laundry appliance as claimed in claim 4, wherein the total area of the perforations in the outer side wall per unit area thereof is at least 10% greater than the total area of the perforations in the inner side wall per unit area thereof.

6. A laundry appliance as claimed in claim 5, wherein the total area of the perforations in the outer side wall per unit area thereof is at least 20% greater than the total area of the perforations in the inner side wall per unit area thereof.

7. A laundry appliance as claimed in claim 1 or 2, wherein the perforations in the outer side wall are all the same size.

8. A laundry appliance as claimed in claim 7, wherein all of the perforations in the outer side wall are larger than any of the perforations in the inner side wall.

9. A laundry appliance as claimed in claim 8, wherein each of the perforations in the outer side wall is larger than each of the perforations in the inner side wall.

10. A laundry appliance as claimed in claim 9, wherein the total area of the perforations in the outer side wall per unit area thereof is at least 10% greater than the total area of the perforations in the inner side wall per unit area thereof.

11. A laundry appliance as claimed in claim 9, wherein the total area of the perforations in the outer side wall per unit area thereof is at least 20% greater than the total area of the perforations in the inner side wall per unit area thereof.

12. A laundry appliance as claimed in claim 8, wherein each perforation in the outer side wall is radially aligned with one of the perforations in the inner side wall.

13. A laundry appliance as claimed in claim 8, wherein each of the perforations in the outer side wall is larger than each of the perforations in the inner side wall.

14. A laundry appliance as claimed in claim 1 or 2, wherein each perforation in the outer side wall is radially aligned with one of the perforations in the inner side wall.

15. A laundry appliance as claimed in claim 1 or 2, wherein all of the perforations in the outer side wall are larger than any of the perforations in the inner side wall.

16. A laundry appliance as claimed in claim 1 or 2, wherein the inner side wall is rigidly attached to the outer side wall and is rotatable therewith.

17. A laundry appliance, comprising an outer housing and a drum mounted rotatably therein, the drum comprising an inner side wall and an outer side wall separate from the inner side wall, the inner and outer side walls being perforated to allow washing liquid to flow into and out of the drum via the perforations, wherein the area of the perforations per unit area of the outer side wall is greater than the area of the perforations per unit area of the inner side wall and wherein the inner side wall is rotatably mounted so as to be rotatable separately from the outer side wall.

18. A laundry appliance as claimed in claim 1 or 2, further comprising a watertight tub in which the drum is rotatably mounted, and wherein the drum is rotatable about an axis which is substantially horizontal.

19. A laundry appliance comprising an outer housing and a drum mounted rotatably therein, the drum comprising an inner side wall and an outer side wall, the inner and outer side walls being perforated to allow washing liquid to flow into and out of the drum via the perforations and the inner side wall being rotatable at least in part relative to the outer side wall wherein the area of the perforations per unit area of the outer side wall is greater than the area of the perforations per unit area of the inner side wall.

20. A laundry appliance as claimed in claim 19, wherein all of the perforations are circular.

21. A laundry appliance as claimed in claim 19 or 20, wherein the perforations in the inner side wall are all the same size.

22. A laundry appliance as claimed in claim 19 or 20, wherein the perforations in the outer side wall are all the same size.

23. A laundry appliance as claimed in claim 19 or 20, wherein all of the perforations in the outer side wall are larger than any of the perforations in the inner side wall.

24. A laundry appliance as claimed in claim 23, wherein the total area of the perforations in the outer side wall per unit area thereof is at least 10% greater than the total area of the perforations in the inner side wall per unit area thereof.

25. A laundry appliance as claimed in claim 23, wherein the total area of the perforations in the outer side wall per unit area thereof is at least 20% greater than the total area of the perforations in the inner side wall per unit area thereof.

26. A laundry appliance as claimed in claim 19 or 20, wherein each perforation in the outer side wall is radially aligned with one of the perforations in the inner side wall.

* * * * *

UNITED STATES PATENT AND TRADEMARK OFFICE

CERTIFICATE OF CORRECTION

PATENT NO. : 7,021,089 B2
APPLICATION NO. : 10/312675
DATED : April 4, 2006
INVENTOR(S) : David Ions It is certified that error appears in the above-identified patent and that said Letters Patent is hereby corrected as shown below:

On Title page, Item (73) Col. 1

Please delete "Dyson Limited" and replace with --Dyson Technology Limited--

Signed and Sealed this

Fifteenth Day of August, 2006

JON W. DUDAS
*Director of the United States Patent and Trademark Office*